US005603161A

United States Patent [19]

Welsh

[11] Patent Number: 5,603,161

[45] Date of Patent: Feb. 18, 1997

[54] WEAR INDICATING SHAVING STRIP AND BLADE ASSEMBLY FOR A SHAVER

[76] Inventor: Christopher A. Welsh, 1104 Park Ave., Balboa Island, Calif. 92662

[21] Appl. No.: 479,184

[22] Filed: Jun. 7, 1995

[51] Int. Cl.[6] ..... B26B 21/54

[52] U.S. Cl. ..... 30/41.7; 30/346.52

[58] Field of Search ..... 30/41.7, 346.52, 30/346.61; 83/522.27

[56] References Cited

U.S. PATENT DOCUMENTS

| | | | |
|---|---|---|---|
| 2,326,774 | 8/1943 | Freedman | 30/346.52 |
| 3,768,161 | 10/1973 | Miller . | |
| 3,879,844 | 4/1975 | Griffiths | 30/346.52 |
| 4,170,821 | 10/1979 | Booth . | |
| 4,573,266 | 3/1986 | Jacobson . | |
| 4,624,051 | 11/1986 | Apprille, Jr. et al. . | |
| 4,683,096 | 7/1987 | Ferraro . | |
| 4,697,342 | 10/1987 | Ferraro . | |
| 4,802,255 | 2/1989 | Breuer et al. . | |
| 4,850,106 | 7/1989 | Braun et al. . | |
| 4,872,263 | 10/1989 | Etheredge, III . | |
| 4,875,287 | 10/1989 | Creasy et al. . | |
| 5,113,585 | 5/1992 | Rogers et al. . | |
| 5,345,680 | 9/1994 | Vreeland et al. . | |
| 5,349,750 | 9/1994 | Tseng . | |
| 5,351,401 | 10/1994 | Werner . | |
| 5,388,331 | 2/1995 | Siamak | 30/41.7 |
| B1 4,170,821 | 10/1992 | Booth . | |

*Primary Examiner*—Kenneth E. Peterson
*Assistant Examiner*—Sean A. Pryor
*Attorney, Agent, or Firm*—Cumpston & Shaw

[57] ABSTRACT

A visual wear indicator which may incorporate a shaving aid, such that the visual wear indicator corresponds to released shaving agents, wear or oxidation of a cutting edge. The visual wear indicator may include a shaving aid composite which exhibits a first color to the user during an initial use and a different color during a subsequent use, wherein the transition from the first color to the second color is designed to correspond to a predetermined parameter of the shaver. The visual wear indicator may also include a metallic surface having an oxidation rate which parallels the oxidation rate of a cutting edge and provides a sufficient surface area to exhibit a second color upon detrimental oxidation of the blade.

18 Claims, 6 Drawing Sheets

WEAR INDICATING SHAVING STRIP AND BLADE ASSEMBLY FOR A SHAVER

FIELD OF THE INVENTION

The present invention relates to a visual wear indicator for a shaver, more particularly, to a visual wear indicator which may incorporate a shaving aid such that the visual wear indicator corresponds to wear, or oxidation of a cutting edge and/or released or depleted shaving agents.

BACKGROUND OF THE INVENTION

Attempts have been made to incorporate a shaving aid having for example, but not limited to a lubricant, whisker softener, razor cleanser, medicinal agent, cosmetic agent, or combination thereof into a razor, by depositing the shaving aid in a recess on the razor, by incorporating a shaving aid directly into one or more molded polymeric components of the razor, by adhesively securing the shaving aid composite to the razor, and by use of a mechanical connection between the shaving aid composite and the razor. A water soluble shaving aid can be mixed with non-water soluble material, for example polystyrene polymer to form an insoluble polymer/soluble shaving aid composite. The composite has been mounted on a shaver adjacent the shaving edge or edges, in single or multiple blade systems. Upon exposure to water, the water soluble shaving aid leaches and abrades from the composite onto the skin.

While shaving comfort can be enhanced, at least to some extent, with the various components included in the shaving aid composite, it is difficult to assess the remaining useful quantity of active ingredients in the composite. That is, many shaving aid composites include a soluble and non-soluble portion, such that the nonsoluble portion houses the soluble portion and the soluble portion leaches from the nonsoluble portion to apply the active ingredients to the shaving aid of the skin. Absent discomfort in shaving, the user is unable to directly ascertain the amount of soluble or active ingredients remaining in the shaving aid composite.

In addition to the application of shaving aids, the condition of the cutting edge of the blade is critical in the performance of the shaver. That is, there is no amount of shaving aids that can accommodate a dull blade. The blade may become dull by extended use or mere oxidation of the cutting edge. That is, even if a blade is not used, oxidation can render the blade unusable. As disclosed herein, dulling through repeated use can be approximately monitored. However, the need still exists for indicating the degree or amount of oxidation on the cutting edge of the blade.

Therefore, the need exists for a visual wear indicator which provides a visual indication of the status of the shaver. Specifically, the need exists for a visual wear indicator including a shaving aid composite which indicates at least the approximate amount of remaining active ingredients or the anticipated useful life of the shaver. The need further exists for a visual wear indicator which provides an indication of oxidation on a cutting edge. The need also exists for prompting users to discard old or used shavers in favor of new shavers.

SUMMARY OF THE INVENTION

A shaver having a visual wear indicator is disclosed. The visual wear indicator may include a wear indicating shaving aid composite and/or an age indicating blade. The shaving aid composite exhibits a first color to the user during an initial use and a different color is exhibited during a subsequent use. Preferably, the second color appears in response to a predetermined amount of use or when a portion of the original amount of active, dispersible or soluble ingredients remain available for the user. The appearance of the second color may be specifically set in relation to a number of average uses, and hence wear of the blade.

The age indicating blade includes an oxidation strip on the metal blade which exhibits the same degree of oxidation occurring on the sharpened cutting edge of the blade. Following oxidation, the oxidation strip exhibits a different color than an adjacent portion of the blade. The user is then able to ascertain the extent to which the blade is dulled by oxidation due to exposure to the ambient environment, independent of actual use of the blade.

The visual wear indicator of the present invention thereby permits the user to assess the remaining useful life of a shaver with respect to shaving aid agents, use, or blade life. The regular replacement of shavers will help users obtain a more comfortable shave and permit manufacturers to sell more replacement shavers.

DETAILED DESCRIPTION OF THE PREFERRED EMBODIMENTS

Figure 1:
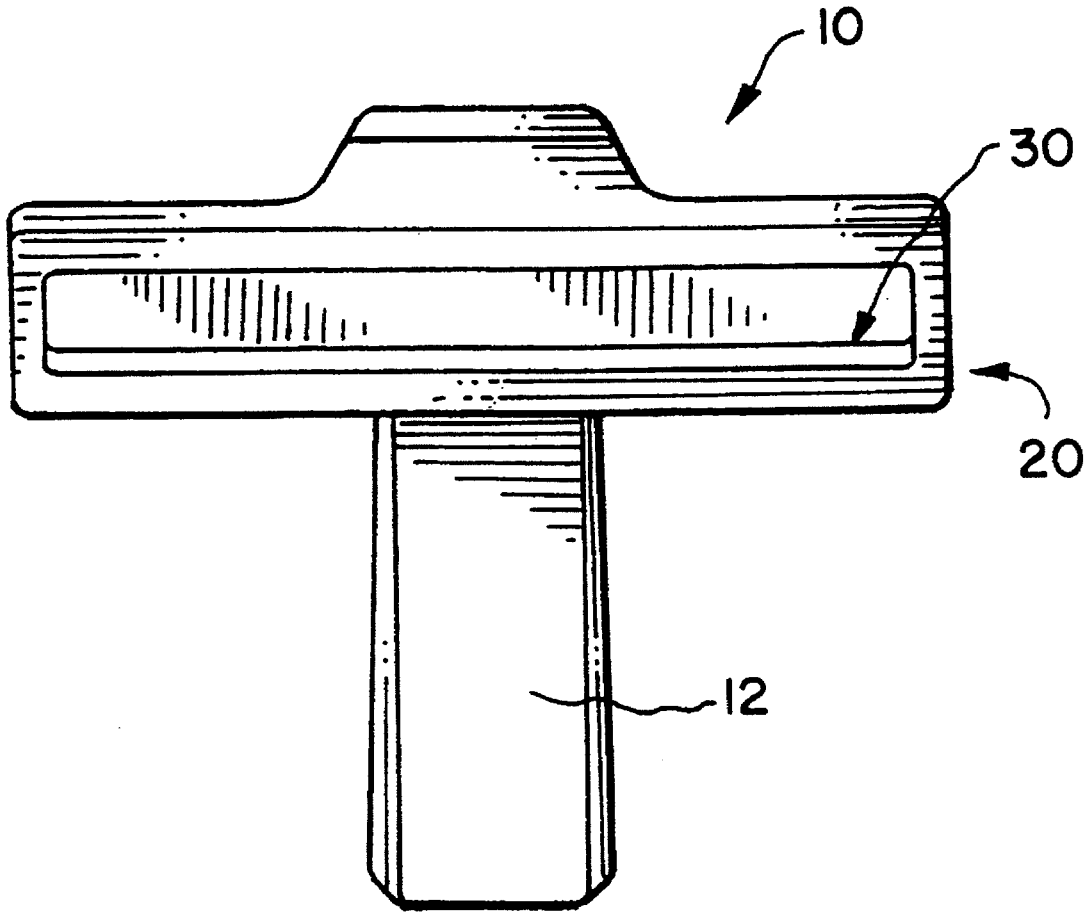
FIG. 1 is a front elevational view showing a shaver with a handle.
Figure 2:
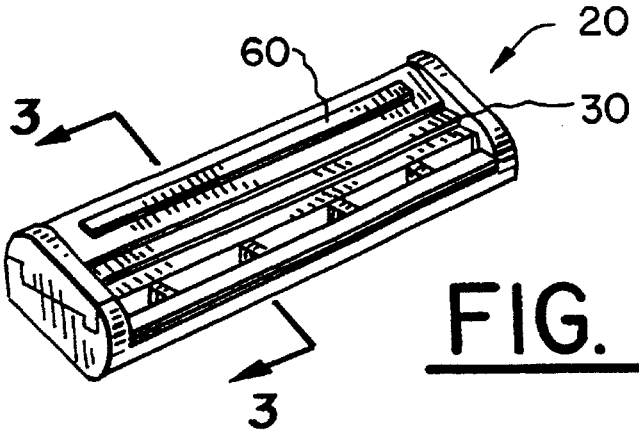
FIG. 2 is a perspective view of a shaving cartridge for a shaver.
Figure 3:
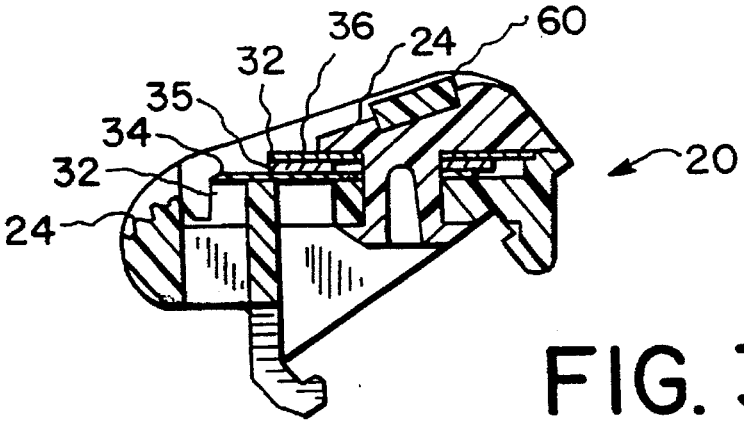
FIG. 3 is a cross sectional view taken along lines 3—3 of FIG. 2.
Figure 4:
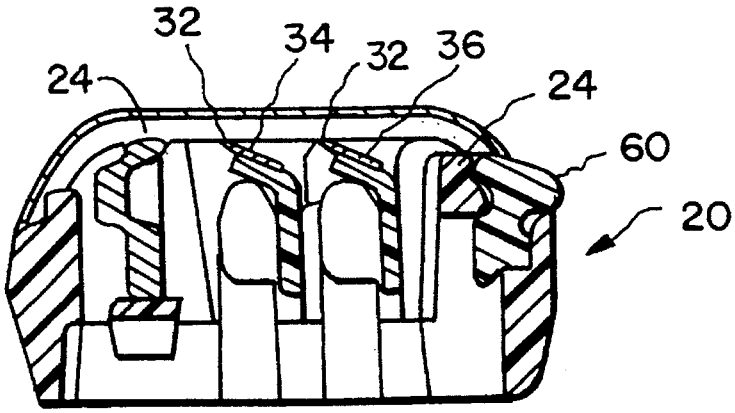
FIG. 4 is a cross sectional view showing an alternative construction.
Figure 5:
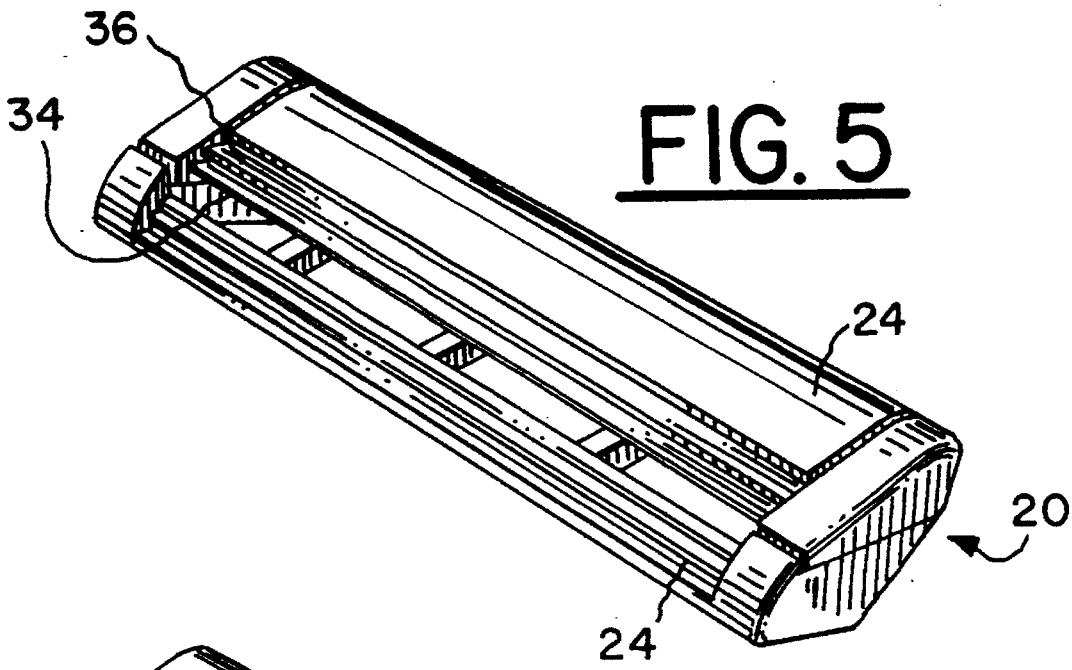
FIG. 5 is a perspective view of a further embodiment.

As shown in FIG. 1, a shaver 10 includes a handle 12, or frame which cooperates with a cartridge 20 to retain a blade or blades 30. Referring to FIGS. 2–6 and 8, the cartridge 20 is molded high impact polystyrene and includes an integral coupling groove 21 (not shown) for attachment to the handle 12. The shaver 10 includes a skin engaging portion 24 which may be located on either side of the blade 30. That is, the skin engaging surface 24 may contact the skin before the blades 30 and after the blades contact the skin. The shaver 10 may include a guard bar not shown for smoothing the skin adjacent to a cutting edge 32 of blade 30. As shown in FIGS. 2–6, the shaver may include a steel leading blade 34 having a sharpened edge 32, a steel following blade 36 having a sharpened edge 32, and a spacer 35 that maintains the blades in a spaced relation are disposed on the upper surface of the cartridge 20. Alternatively, the shaver 10 may be of a disposable type wherein the entire shaver, including blades, is replaced on a periodic basis.

Even though the cartridge 20 has been illustrated as being of the twin-blade type, it should be understood that this structure is shown for purposes of illustration only and that the invention described in detail hereinafter is applicable to not only twin-bladed cartridges but equally as well to single or any multiple-bladed shaving cartridge, including but not limited to disposable and interchangeable cartridges. Furthermore, these basic components of the cartridge 20 are fused, cemented, or otherwise bonded together and hence have become well-known and commonly referred to in the trade as bonded razor blade cartridges.

The visual wear indicator is attached to the shaver 10 to provide a visual indication of the status of the shaver 10. The visual wear indicator may include one, or both of, a shaving aid composite 60 and an oxidation indicator 40. The shaving aid composite 60 encompasses composites which release shaving aiding agents, as well as a merely abradable or wearable material, or material which changes appearance in response to exposure to specific elements such as water.

As shown in FIGS. 2–4, 6 and 8, affixed to the skin engaging surface 24, is the shaving aid composite 60. The term "shaving aid composite" refers to a shave aiding agent combined with a solid water soluble micro encapsulating or micro porous structure which retains the agent or to that agent itself being a water soluble solid. "Shaving aid composite" also includes an abradable or wearable material which is dispensed through the abrasion or wearing of the material. That is, the shaving aid composite may be a wear indicator, independent of dispersing shave aiding agents. Further, the present invention may be employed in any of a variety of shaving aid composites 60 including but not limited to ethylene vinyl acetate, hydrogels, water insoluble matrices. In each construction, the shaving aid composite 60 presents a first color in an initial use and a second different color during a subsequent use. The exposure of the second color may result from the successive leaching of active components of the shaving aid composite, or abrasion of a water insoluble matrix. The appearance of the second color may also be in response to an average number of uses to indicate an amount of user induced wear on the blade, or anticipated life of the blade. It is contemplated the second color will appear within the useful life of the shaver 10.

Alternatively, the second color may be encapsulated in a more water resistant material than that encapsulating the first color. Therefore, while encapsulating materials are substantially equally exposed to water, the second color leeches only after a substantial portion of the first encapsulating material has released the first color.

Further, it is contemplated the disclosed materials may be arranged to form a lubricating layer which over lies a wear indicating layer having a different color. The wear indicating layer may be a differently dyed batch of the same material as the lubricating material, or may include a leachable color which eventually passes into the lubricating layer to change the color of the lubricating layer.

Also, the lubricating layer may be a first color and substantially water soluble, and the wear indicating layer includes a water insoluble matrix of a second different color having a water soluble shaving aid agent impregnated. Therefore, as the lubricating layer is dispersed and becomes translucent, the color of the underlying wear indicating matrix becomes increasing prominent, thereby signally the user that the reserve shaving aid agents in the wear indicating layer are about to be consumed, and by extension, the blade is wearing out.

The appearance of the second color may be designed to be a gradual progression, a relatively quick transition (within a few uses) or a relatively sudden transition to an intermediate gradation. That is, in a multi-layer configuration, if the first color is a light color, such as white, and the second color is dark, or bright color, and as the white color thins, the second color slowly appears. If the respective colors are encapsulated or encapsulate the shaving agents, the first and second color may be set in the shaving aid composite to exhibit a generally gradual or abrupt color change. The transition from the first color to the second color may be a linear progression, wherein the linear progression substantially matches that of a linear release of shaving aid agents. The linear release of polyethylene oxide as a function of time is disclosed in U.S. Pat. Nos. 4,624,051 and 5,113,585 incorporated herein by reference.

The shaving aid composite 60 may include one or various combinations of the following agents:

A. A lubricating agent for reducing the fictional forces between the shaver and the skin.

B. An agent which modifies the chemical structure of the hair to allow the blade to pass through the whiskers very easily, such as a depilatory agent.

C. A cleaning agent which allows the whisker and skin debris to be washed more easily from the razor parts during shaving such as sodium larnyl sulfate.

D. A medicinal agent for killing bacteria, or repairing skin damage and abrasions.

E. A cosmetic agent for softening, smoothing, conditioning or improving the skin.

F. A blood coagulant for suppression of bleeding that occurs from nicks and cuts.

G. Agents for purposes unrelated to the wear indicator.

The configuration of the shaving aid composite 60, its place of application to the shaver 10, the manner of attachment and/or other means and methods of incorporation may vary widely to fit particular requirements, and accordingly, modifications of the disclosed embodiments are available. The shaving aid composite 60 may be formed by a variety of methods and materials as set forth in U.S. Pat. Nos. 4,872,263; 4,875,287; 5,345,680; and 5,349,750 incorporated herein by reference.

Ethylene Vinyl Acetate

The shaving aid composite 60 may be a matrix of water insoluble ethylene vinyl acetate (EVA) and an effective amount of one or more shaving agents disposed in the ethyl vinyl acetate matrix which leaches out with water polyethylene oxide. The shaving aid composite 60 can also be a mixture of ethylene vinyl acetate and an effective amount of one or more water insoluble shaving agents (such as silicon copolymer or polydetriflorine ethylene (Teflon) powder). An EVA composition is disclosed in U.S. Pat. No. 5,349,750 and is incorporated herein by reference.

Shaving aid composites 60 formed from ethylene vinyl acetate copolymers can be molded, extruded, or otherwise manufactured at relatively low temperatures. The ethylene vinyl acetate copolymer may also act as a hot melt adhesive thus providing a simple and effective means of attaching the shaving aid composite 60 to a shaver 10 or cartridge 20.

The nature and relative proportions of the water-soluble and non-water soluble components and water insoluble ethylene vinyl acetate in the polymer blend should be such that the shaving aid composite 60 has adequate mechanical strength, both as initially produced and after a significant mount of the water-soluble material has been leached out, the quantity of the water soluble material being sufficient to provide effective shaving assistance, such as lubrication, for the entire expected life of the blade or blades. In case of a water soluble component contained in the shaving aid composite, comfortable and effective shaving can be obtained by wetting the shaving area with water prior to shaving. The water present on the shaving area leaches out a proportion of the water-soluble material for delivery to the skin surface.

The following examples show by way of illustration and not by way of limiting practice of the invention.

EXAMPLE I

Figure 6:
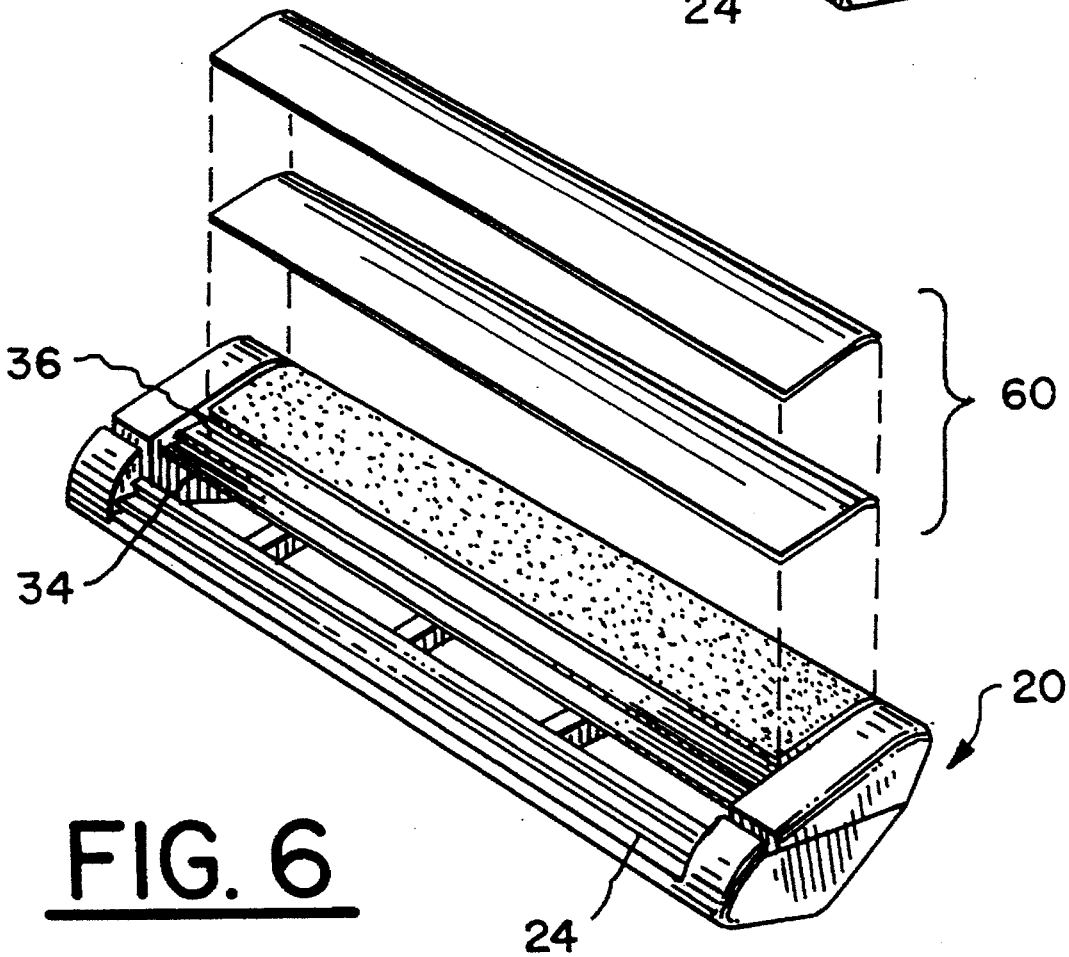
FIG. 6 is an exploded perspective of the embodiment of FIG. 5.

A first blend is formed of ethylene vinyl acetate (twenty-five percent vinyl acetate) (Elvax 360) and a first color dye and bactericide additives in minor amounts. The first blend is extruded to form a first strip of the shaving aid composite having the first color dye. A second blend of the same composition, but having a different color dye is extruded to form a second strip of the shaving aid. Referring to FIG. 6, the first and second strips may be bonded together or coextruded to form an integral unit. Preferably, the combined strips contain sufficient shaving aid agents to provide effective shaving assistance for the entire expected life of the blade or blades 30. Further, the second strip which leaches or exhibits the different second color providing the user with an indication of the remaining expected use of the shaving aid composite 60, the blade 30 or both. For example, the second color may represent 5 to 25% of the total anticipated useful life of the shaving aid composite 60 or blades 30. The strips are selected so that sufficient wearing or abrasion of the first strip during the anticipated useful life eventually presents the second color to the user to indicate the limited remaining available useful life. Referring to FIGS. 3–5 and 8, the combined strips may be cut to form a member which is secured to the shaver 10 at a skin engaging surface 24. In similar manner, the blend is extruded to form inserts which are secured in openings of the shaver 10.

EXAMPLE 2

A first blend of ethylene vinyl acetate copolymer (containing twenty-five percent vinyl acetate) and silicone copolymer and a first color dye is extruded. As in the prior examples, a second blend of a second color is formed and used in conjunction with the first strip. The extruded strip is secured to the skin engaging surface 24.

EXAMPLE 3

A first blend of vinyl acetate (twenty-five percent vinyl acetate)sucrose stearate; and a water-soluble polymer and a first dye is molded to form a first member. Again, a second blend of a second color is formed and molded. The first and second blends may be co-molded or subsequently bonded. The resulting shaving aid composite 60 member is secured to skin engaging surface 24.

EXAMPLE 4

A first mixture of ethylene vinyl acetate (twenty-five percent vinyl acetate); Polyox Coagulant polyethylene oxide; Polyox WSRN-750 polyethylene oxide; silicone wax and a first color dye is molded. A second mixture having a second color dye is molded and bonded or co-molded. The same mixtures may be extruded or co-extruded and attached to shaver 10.

Shavers 10 are used in conventional manner with polyethylene oxide and/or other shaving aid material being dispensed from the shaving aid composite 60 during shaving. With each stroke of the shaver 10, shaving aid agents are immediately applied to the skin and thus provide shaving aid agent that is continually renewed during shaving operations over the useful life of shaver 10.

Therefore, to embody the present invention, the EVA shaving aid composite 60 of the visual wear indicator may be formed in a multiple layer construction, wherein different layers exhibit different colors, by extrusion and bonding or coextrusion. Alternatively, the shaving aid composite 60 may be partially dyed, so that initial agent leaches do not bleed the dye, while subsequent leaches bleed the dye, thereby presenting different colors to the user over the useful life of the shaver 10.

Water Insoluble Matrix

Another embodiment of the visual wear indicator of the present invention provides a shaving aid composite 60 exhibiting improved bonding characteristics as well as shelf stability even in extreme environments when bonded to a shaver 10, particularly to a shaver formed substantially from polypropylene. The shaving aid composite 60 of this embodiment comprises at least one water-soluble polymeric component, such as polyethylene oxide, and a water-insoluble matrix comprising polystyrene and polypropylene. The formation of such matrix is disclosed in U.S. Pat. No. 4,872,263 incorporated herein by reference.

As with the other embodiment, the configuration of the shaving aid composite 60, its place of application to the shaver 10, the manner of attachment and/or other means and method of incorporation may vary widely to fit particular design requirements.

An embodiment of the present invention may form a flexible shaver head formed substantially of polypropylene, for example comprising at least 75% or preferably at least 90% polypropylene, having the above described shaving aid composite bonded thereto.

A shaver 10 having the visual wear indicator may be formed by 1) securely positioning at least one blade 30 in a mold cavity; 2) molding a flexible shaver by injecting at least one polymer, preferably polypropylene, into the mold cavity; 3) modifying said mold cavity to receive a shaving aid composite on the flexible shaver; and 4) subsequently injecting a polymeric blend into the modified mold cavity, wherein the polymeric blend comprises: polypropylene, at least one polymer from the group consisting of ABS and polystyrene, and at least one water-soluble active ingredient, preferably comprising polyethylene oxide; wherein the polymeric blend exhibits a first color during initial use and second different color during a subsequent use. Alternatively, a first color blend may be injected followed by a second color blend. The process of insert molding a flexible razor head is generally described in U.S. Pat. No. 5,345,680, incorporated herein by reference.

Figure 7:
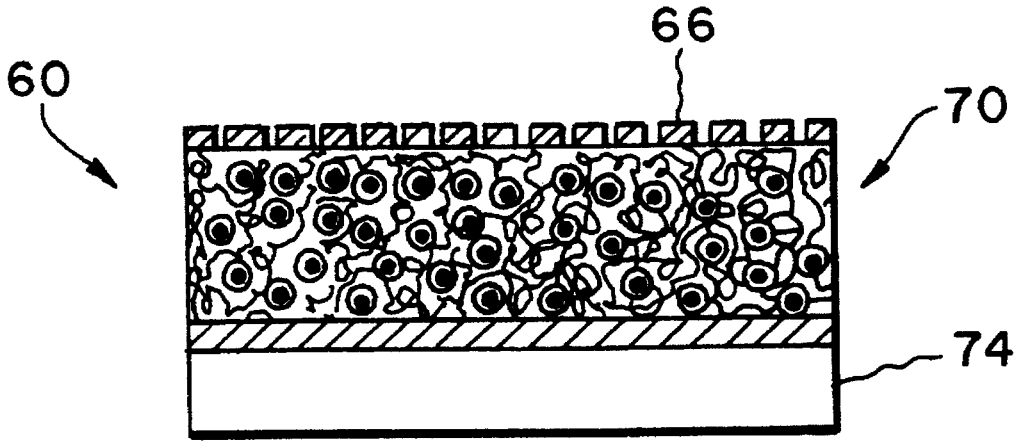
FIG. 7 is a cross sectional view of a shaving aid composite.
Figure 8:
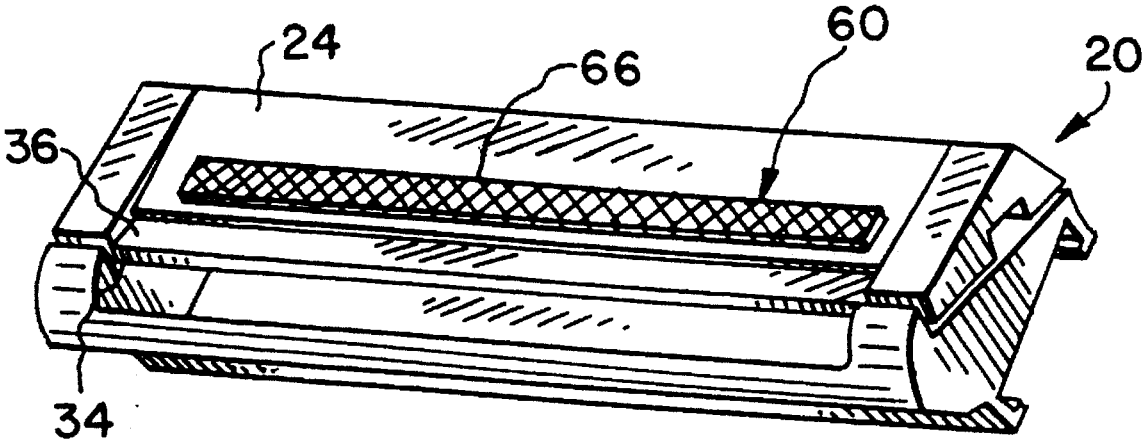
FIG. 8 is a perspective view of the shaving aid composite on a shaver.

Referring to FIGS. 7 and 8 in a water insoluble polystyrene/polypropylene matrix embodiment, either the matrix 70 or the water soluble active ingredient may include a first color and a second different color. That is, as the matrix 70 is abraded during normal use, the newly exposed portion may include the second color.

In this embodiment the shaving aid composite 60 comprises a perforated, smooth water-insoluble sheet material 66 secured to one major surface of the porous, water-insoluble matrix 70 containing or impregnated with an acid soap, e.g. a soap of an unsaturated higher fatty acid containing at least sixteen carbon atoms or shaving aid agents.

When wetted, for example, in the course of shaving, a portion of the soap or shaving aid agents will diffuse through the perforations in the overlying perforated sheet 66 to contact and thereby lubricate the skin or other substrates in proximal relationship therewith.

While not an essential component of the invention, the surface of the matrix 70 opposed from sheet 66 is shown to contain an adhesive layer 74 for laminating the device to a support member, or substrate of the article with which it is to be utilized, e.g. a disposable shaver.

The shaving aid agents may include a lubricious acid soap comprising at least an alkaline metal salt, preferably a sodium or potassium salt, of an unsaturated fatty acid having at least 16 carbon atoms.

The two colors may be incorporated into the water in soluble matrix system in a variety of ways. For example, the impregnation of the water insoluble matrix may be a two step process, wherein a first colored agent is introduced, followed by a second color agent. Alternatively, a first matrix impregnated with a first color agent and a second matrix impregnated with a second color agent is bonded to the first matrix.

The shaving aid composite 60 is adhered to the cartridge 20, e.g. in a recess provided thereof. The manner of adherence is not critical and may for example be by means of an adhesive layer 74 as shown in FIG. 7, heat sealing, spot welding, or any of the other known methods of joining two substrates including photopolymerization to form an adhesive. In any event, shaving aid composite 60 will be disposed in juxtaposition with the edge 32 of blade 30 and will extend from a point adjacent one end of the razor blades 30 to a point similarly adjacent to the opposite end of the blade.

By way of illustration, the shaving aid lubricant may be introduced into the matrix 70 as a melt, e.g. at 50° C., and then allowed to cool. The second color agent or lubricant may then be introduced into the matrix. Before or after impregnating the matrix with the lubricious agent, the perforated top sheet may be heat sealed to the matrix around its periphery. An adhesive, e.g. a pressure-sensitive or heat-sensitive adhesive 74 of known formulation may then, if desired, be applied by conventional coating procedures onto the underside of the matrix 70, i.e. the surface opposed from the surface adhered to the perforated sheet material 66. Many variations in the method of manufacture will of course be readily apparent. For example, it is contemplated that the shaving aid agents may be applied as an emulsion or the adhesive may be coated onto the matrix 70 prior to impregnation with the lubricious vehicle.

Hydrogels

Alternatively, the shaving aid composite 60 may include a hydrogel in which water soluble polymers are rendered insoluble to prevent their dissolution and separation from the surface of the shaving aid composite in the presence of water. The formation of hydrogels is disclosed in U.S. Pat. No. 4,875,287 incorporated herein by reference.

The hydrogel provides a highly effective and long-lasting lubricious coating can be provided to a shaver 10, such as a shaving head, which even after repeated use, retains a smooth draw across the skin of the user. Contrary to devices in which the hydrophilic component is intentionally dissolved and, consequently, dissipated during use, the hydrogel substantially retains its lubricious effect during exposure to moisture even after repeated use, for substantially the life of the shaver 10 being subject only to loss due to abrasion resulting from scraping action against the face of the user.

Referring to FIG. 6, the hydrogel can be provided to the surface of the skin-engaging surface 24 as a coating, or as a film or sheet. Alternatively, the hydrogel film may be bound to other plastic films or fabrics which are in turn bound to the shaver 10. The hydrogel and the plastic films or fabrics can be adhered to the surface of the skin-engaging surface 24 with the assistance of an adhesive such as a polyurethane or an acrylic.

The two color hydrogel shaving aid composite 60 may be formed by applying a first coating of a first color and a second coating of a second color. The thickness of the separate coatings are selected so that sufficient wearing or abrasion of the coating occurs during the useful life of the corresponding blade so that the second color is eventually presented to the user to indicate the limited remaining available useful life of the product. Alternatively, the water soluble agents leaching through the hydrogel may provide the first and the second colors, such that only a single hydrogel layer is employed.

Colored Layer and Contoured Support Surface

Figure 9:
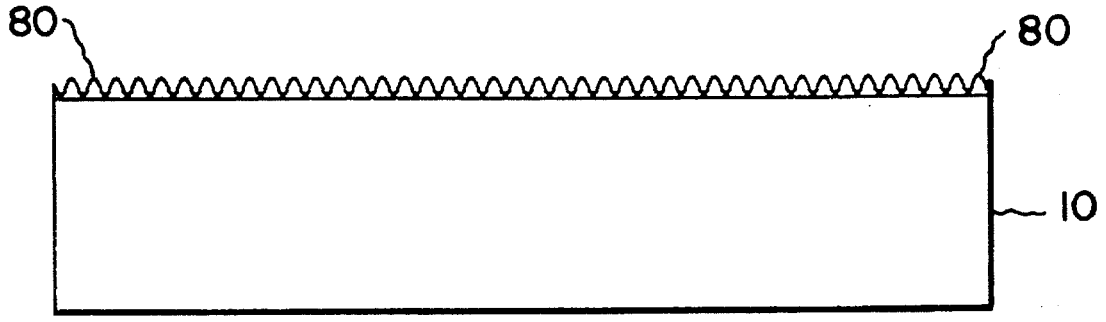
FIG. 9 is a cross sectional view of a contoured portion of a shaving aid composite.
Figure 10:
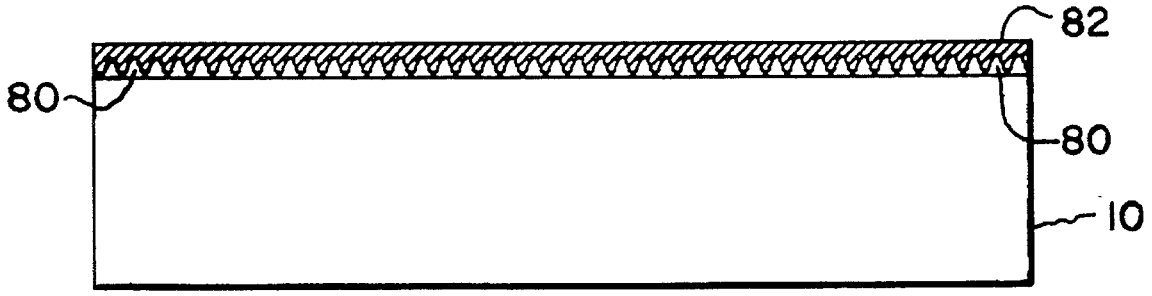
FIG. 10 is a cross sectional view of the contoured shaving aid composite.
Figure 11:
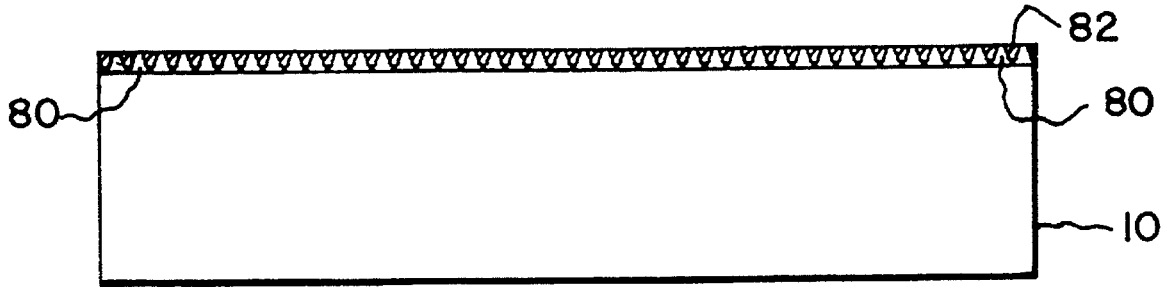
FIG. 11 is a cross sectional view of the contoured shaving aid composite after use.

Referring to FIGS. 9–11, the color change in the visual wear indicator can also be formed by a cooperation of the shaver 10 and the composite shaving aid 60. In this embodiment, the shaver 10, or underlying layer of the shaving aid composite 60 is formed with a plurality of bumps or projections 80. That is, the shaver 10, may be formed with the projections 80 as an integral part thereof. Alternatively, the bumps 80 may be formed as an underlying layer, which in turn is attached to the shaver 10. The projections 80 have a second color. An overlying layer 82 is disposed on the projections to fill interstitial spaces between the projections and cover the tops of the projections. The overlying layer 82 exhibits a first color.

As the overlying layer 82 is dispersed or worn away, the second color in the projections 80 becomes more and more visible. The color of the visual wear indicator thereby changes in response to use of the shaver 10. The overlying layer 82 may include shaving agents, or can be formed of a dispersible material, which gradually exposes the projections 80. The specific shape and spacing of the projection 80 and relative size of the overlying layer 82 are selected to provide the desired color change parameter of the visual wear indicator.

Oxidation Indicator

The visual wear indicator of the present invention may also include an oxidation indicator 40 on or near the metallic blade 30 for providing a visual indication of the extent of oxidation experienced by the sharpened or cutting edge 32. The sharpened edge 32 of the blade is dulled by oxidation, as well as use. That is, an unused or seldom used blade 30 will eventually dull due to oxidation. Since the surface of the cutting edge 32 is so small and narrow, it is difficult for the user to assess the condition of the blade 30.

Therefore, an "old" unused blade, though appearing as a new blade, will only exhibit its dull characteristics upon use when the skin is violated. By recreating a pattern of many similar surfaces close together, an otherwise faint or substantially undetectable change can be made more readily visible. The oxidation indicator strip 40, tracks the amount of oxidation experienced by the sharpened edge 32.

The oxidation indicator 40 is particularly employed with metallic implements having a sharpened edge 32. It is understood the oxidation indicator 40 may be used with coated or uncoated metallic implements. The oxidation indicator 40 includes an exposed surface 42 (not shown) that is visible to the user. The exposed surface is preferably formed of the same material as the sharpened edge 32 and has a contour which oxidizes at substantially the same rate as the sharpened edge. The oxidation indicator 40 is preferably in the form of a symbol or word such as "worn" "used" or "discard".

Figure 12:
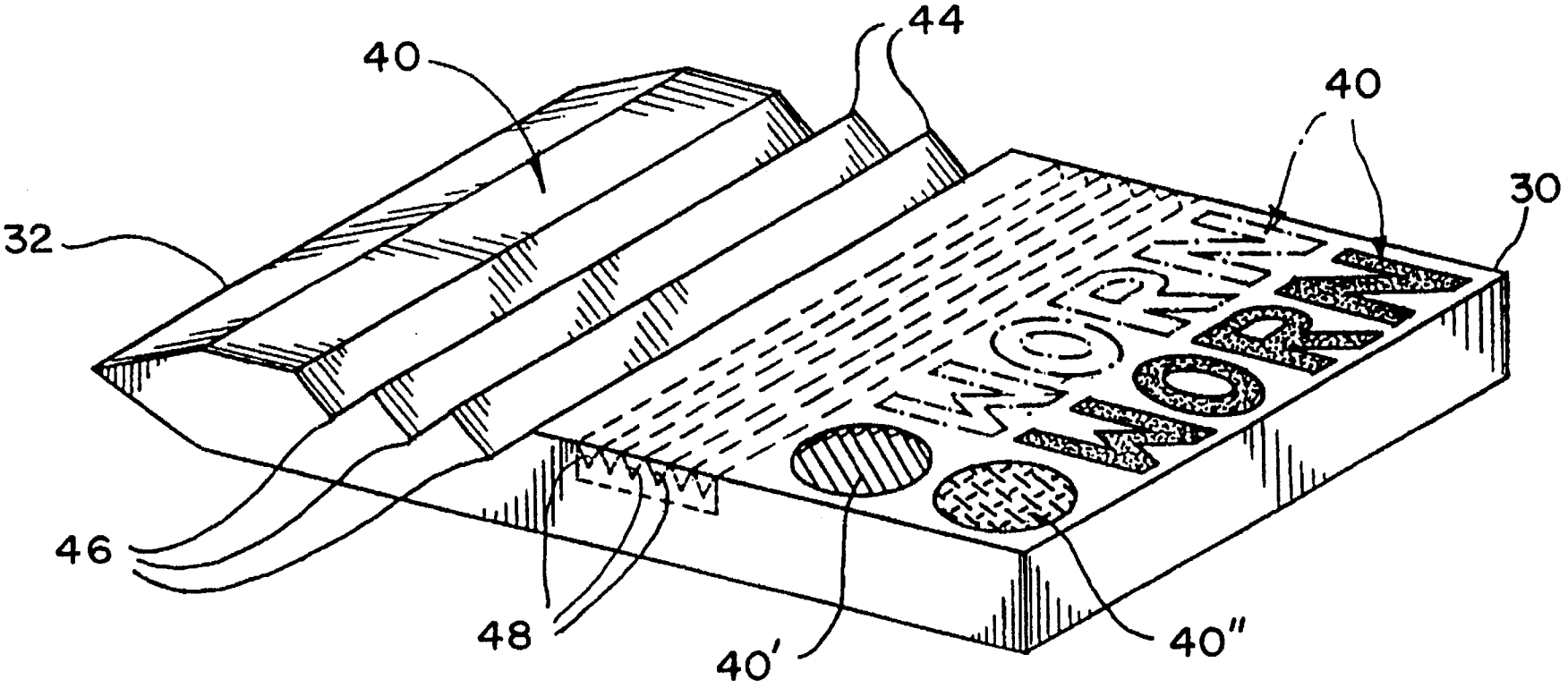
FIG. 12 is a perspective view of a metallic blade having an oxidation strip.

The oxidation indicator 40 is generally formed in the blade 30 by roughening (abrading) or stamping a portion of the blade. Referring to FIG. 12, this process forms a plurality of minute peaks 44 and valleys 46 in the blade 30. The acute edges of the peaks 44 are similar in sharpness or radii to the sharpened edge 32 and therefore, generally exhibit a similar degree of oxidation as the sharpened edge. As the multiple adjacent peaks in the oxidation indicator 40 oxidize and change color, the user is able to assess the corresponding oxidation damage to the sharpened edge 32.

The valleys 46 retain water or moisture in the oxidation indicator 40 and the water promotes oxidation at a rate that parallels the sharpened edge. As the rate of oxidation is generally determined by the acuteness of the peaks 44, the formation of the oxidation indicator 40 may be selected so that the peaks accurately mimic the sharpened edge 32. The necessary roughness in the oxidation indicator 40 may be formed by roughening, photo etching, stamping or abrading an area of the blade. The oxidation indicator 40 may exhibit any of a variety of roughnesses.

The oxidation indicator 40 can be formed so that the amount of oxidation can be gauged against a scale. Specifically, a plurality of micro grooves or channels 48 are formed in the blade 30 (shown enlarged for clarity in FIG. 12). The channels 48 are covered with a metal lacquer such that the ends of the channels are exposed. Water enters the micro channels 48 from an exposed end and seeps along the channel between the lacquer and the channel. The rate of penetration of the water is set by the configuration of the channels 48 and the filling of the channels by the lacquer. Therefore, the micro channels 48 will initially exhibit oxidation adjacent the exposed ends and the visible oxidation will migrate along the micro channel 48 only as the water penetrates. Therefore, the user can determine the amount of oxidation by inspecting the length of discoloration along the micro channel 48. The micro channels may be in a parallel orientation, or random orientation as formed by abrading.

Therefore, as the sharpened edge 32 of the blade 30 is continually and unobservably dulled by oxidation, the oxidation indicator 40 presents a larger surface to the user that shows a parallel extent of oxidation and hence discoloration, so that the intended user may gauge the oxidation damage on the unused blade, prior to subjecting the skin to the oxidized blade.

A chart or specific oxidation color may be presented for comparison, so that the user can relatively accurately gauge the amount of oxidation damage to the sharpened edge.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed:

1. A shaving apparatus, comprising:

(a) a blade having a shaving edge;

(b) a blade support; and (c) a visual wear indicator exhibiting a first color visible in an initial use of the shaving apparatus and a second different color in a subsequent use of the shaving apparatus during a useful life of the shaving apparatus, the second color indicative of wear of the shaving apparatus, wherein the visual wear indicator includes an oxidation indicator spaced apart from the shaving edge and having substantially the same oxidation resistance as the shaving edge, the oxidation indicator exhibiting a different color than an adjacent portion of the blade upon oxidation of the oxidation indicator.

2. The shaving apparatus of claim 1, wherein the water insoluble portion forms a matrix and the water soluble portion is substantially impregnated in the matrix.

3. The shaving apparatus of claim 1, wherein the visual wear indicator includes a first dye encapsulated in a first water soluble material having a first solubility rate and a second different color dye in a second water soluble material having a second lower solubility rate.

4. The shaving apparatus of claim 1, wherein the visual wear indicator includes a first substantially water soluble layer of a first color having shaving aid agents and a second layer having a second different color.

5. The shaving apparatus of claim 4, wherein the second layer includes shaving aid agents.

6. A visual wear indicator for a shaver, comprising:

(a) a layer of lubricating material having a first color;

(b) a water soluble wear indicating layer of a second color, wherein the lubricating layer contacts a user in an initial use of the shaver and the wear indicating layer contacts the user in a subsequent use of the shaver during a useful life of the shaver; and (c) a visual wear indicator including an oxidation indicator spaced apart from a shaving edge and having substantially the same oxidation resistance as the shaving edge, the oxidation indicator exhibiting a different color than an adjacent portion of a blade upon oxidation of the oxidation indicator.

7. The visual wear indicator of claim 6, wherein the wear indicating layer has a different color than the layer of lubricating material.

8. The visual wear indicator of claim 6, wherein the wear indicating layer includes a lubricating material.

9. The visual wear indicator of claim 6, wherein the lubricating material is water soluble.

10. A multiuse shaver, comprising:

(a) a visual wear indicator having a plurality of agents, one of the agents being leachable to separate from the remaining visual wear indicator during use, the visual wear indicator exhibiting a first color during an initial use and a second different color during a subsequent use within a useful life of the shaver, and an oxidation indicator spaced apart from a shaving edge and having substantially the same oxidation resistance as the shaving edge, the oxidation indicator exhibiting a different color than an adjacent portion of a blade upon oxidation of the oxidation indicator.

11. A shaving apparatus, comprising:

(a) a blade having an oxidizable shaving edge, the blade including a visual wear indicator spaced apart from the shaving edge and having substantially the same oxidation resistance as the shaving edge, the visual wear indicator exhibiting a different color than an adjacent portion of the blade upon oxidation; and (b) a blade support for retaining the blade.

12. The shaving apparatus of claim 11, further comprising:

(a) a dispensable shaving aid composite adjacent the shaving edge exhibiting a first color visible upon an initial use and a second color visible upon a subsequent use.

13. The shaving apparatus of claim 11, wherein the visual wear indicator includes a plurality of micro channels, the micro channels having an oxidation rate substantially equal to the shaving edge.

14. The shaving apparatus of claim 13, further comprising a water insoluble coating on at least a portion of the micro channels.

15. An oxidation indicator for a metal piece, comprising:

(a) an oxidizable sharpened surface on the metal piece; and (b) an oxidation indicator spaced apart from the sharpened surface and having substantially the same oxidation resistance as the sharpened surface, the oxidation indicator exhibiting a different color than an adjacent portion of the metal piece upon oxidation.

16. The oxidation indicator of claim 15, wherein the metal piece is a blade for a shaving apparatus.

17. The oxidation indicator of claim 15, further comprising:

(a) cartridge for retaining the metal piece.

18. The oxidation indicator of claim 15, further comprising a wear indicator adjacent the sharpened surface, the wear indicator exhibiting a first color during an initial use and a second color during a subsequent use.

* * * * *